US012325942B2

(12) United States Patent
Beatty

(10) Patent No.: US 12,325,942 B2
(45) Date of Patent: Jun. 10, 2025

(54) FOUR ROLL SERVO DRIVEN YARN FEED MODULE FOR PRECISION YARN FEED

(71) Applicant: Tuftco Corporation, Chattanooga, TN (US)

(72) Inventor: Paul Beatty, Chattanooga, TN (US)

(73) Assignee: Tuftco Corporation, Chattanooga, TN (US)

( * ) Notice: Subject to any disclaimer, the term of this patent is extended or adjusted under 35 U.S.C. 154(b) by 0 days.

(21) Appl. No.: 18/234,357

(22) Filed: Aug. 15, 2023

(65) Prior Publication Data

US 2024/0052539 A1 Feb. 15, 2024

Related U.S. Application Data

(60) Provisional application No. 63/398,181, filed on Aug. 15, 2022.

(51) Int. Cl.

| | |
|---|---|
| ***D05C 15/18*** | (2006.01) |
| ***D05C 15/32*** | (2006.01) |
| *D05C 15/10* | (2006.01) |

(52) U.S. Cl.

CPC ..... *D05C 15/18* (2013.01); *D05C 15/32* (2013.01); *D05C 15/10* (2013.01)

(58) Field of Classification Search

CPC ..... D05C 15/18; D05C 69/12; D05C 15/26; D05C 15/04; D05C 15/32; D05C 15/10

See application file for complete search history.

(56) References Cited

U.S. PATENT DOCUMENTS

| | | | | |
|---|---|---|---|---|
| 2,932,181 | A * | 4/1960 | MacCaffray, Jr. | D04B 15/38 112/80.24 |
| 6,244,203 | B1 * | 6/2001 | Morgante | D05C 15/18 242/364 |
| 6,446,566 | B1 * | 9/2002 | Bennett | D05C 15/18 112/80.73 |
| 6,725,789 | B1 * | 4/2004 | Hall | D05C 15/18 112/80.73 |
| 6,807,917 | B1 * | 10/2004 | Christman | D05C 15/34 112/80.23 |
| 10,072,368 | B2 * | 9/2018 | Mathews | D05C 15/18 |
| 2004/0025767 | A1 * | 2/2004 | Card | D05C 15/34 112/80.73 |
| 2012/0325134 | A1 * | 12/2012 | Beatty | D05C 15/18 112/475.18 |
| 2015/0354118 | A1 * | 12/2015 | Mathews | D05C 15/26 112/220 |
| 2018/0363186 | A1 * | 12/2018 | Mathews | D05C 15/18 |
| 2024/0052539 | A1 * | 2/2024 | Beatty | D05C 15/18 |
| 2024/0200252 | A1 * | 6/2024 | Mathews | D05C 15/14 |

* cited by examiner

*Primary Examiner* — Danny Worrell
(74) *Attorney, Agent, or Firm* — Miller & Martin PLLC

(57) ABSTRACT

A yarn feed module may be provided with four small diameter yarn feed rolls and a plasma treated yarn feed surface to optimize secure yarn grip for precise feeding by servo drive with greater durability and fewer yarn entanglements, utilizing a variety of threading configurations.

20 Claims, 9 Drawing Sheets

FOUR ROLL SERVO DRIVEN YARN FEED MODULE FOR PRECISION YARN FEED

The present application claims priority to U.S. Provisional Ser. No. 63/398,181 filed Aug. 15, 2022.

FIELD OF THE INVENTION

The present invention relates to an improved apparatus that can be operated by servo motors for the precision feeding of one, two, or up to about four yarns from a yarn supply to the needles of a tufting machine.

BACKGROUND OF THE INVENTION

The tufting industry continually seeks methods of producing new visual patterns on tufted fabrics and of improving the delivery of yarn to the fabrics for efficient tufting machine operation, and appearance of the resulting fabrics.

One of the principal elements available for creating of patterns in tufted fabrics is control of the yarns as they are fed and selectively retained in a backing fabric.

Pattern control yarn feed mechanisms for multiple needle tufting machines are well known in the art and may be generally characterized as either roll-type or scroll-type pattern attachments. Roll type attachments are typified by J. L. Card, U.S. Pat. No. 2,966,866 which disclosed a bank of four pairs of yarn feed rolls, each of which is selectively driven at a high speed or a low speed by the pattern control mechanism. All of the yarn feed rolls extend transversely the entire width of the tufting machine and are journaled at both ends. Typical yarn feed rolls would be 3-5" in diameter. There are many limitations on roll-type pattern devices. Perhaps the most significant limitations are: (1) as a practical matter, there is not room on a tufting machine for more than about eight pairs of yarn feed rolls; (2) although the yarn feed rolls can now be driven at a variety of speeds using direct servo motor control, the sheer mass involved makes quick stitch-by-stitch adjustments challenging; and (3) the threading and unthreading of the respective yarn feed rolls is very time consuming as yarns must be fed between the yarn feed rolls and cannot simply be slipped over the end of the rolls, although the split roll configuration of Watkins, U.S. Pat. No. 4,864,946 provides a technique to minimize this last problem.

The pattern control yarn feed rolls referred to as scroll-type pattern attachments are disclosed in J. L. Card, U.S. Pat. No. 2,862,465, are shown projecting transversely to the row of needles, although subsequent designs have been developed with the yarn feed rolls parallel to the row of needles as in Hammel, U.S. Pat. No. 3,847,098. Typical of scroll type attachments is the use of a tube bank to guide yarns from the yarn feed rolls on which they are threaded to the appropriate needle. In this fashion yarn feed rolls need not extend transversely across the entire width of the tufting machine and it is physically possible to mount many more yarn feed rolls across the machine. Scroll pattern attachments often have between 36 and 120 sets of rolls. Originally with the use of electrically operated clutches each set of rolls could select from two, or possibly three, different speeds for each stitch, however modern designs with servo motor driven yarn feed rolls have been programmed for additional speeds to feed a wider variety of yarn lengths.

In the original servo scroll, yarns were fed around relatively large yarn feed surfaces as depicted in FIGS. 1A and 1B. In these assemblies, tube banks were used, spreading yarns in repeats across the width of a tufting machine. This is because a plurality of yarns 16, as shown in FIG. 1B would be wrapped around a yarn feeding surface 41, such as sandpaper, on a first forward yarn feed roll 36 and thence rearward to the second rear yarn feed roll 37, again passing around the yarn feed surface 41 and thence forward to the yarn feed tube bank. FIG. 1A shows an end view of the yarn feed servo motors 38 and yarn feed rolls on a mounting plate 35 that can be attached by mounting tabs 53 to form a larger yarn feed attachment. Servo motors 38 on either side of mounted plate 35 drive the yarn feed rolls through drive sprockets 39 that in the original servo scroll configuration were mounted on rotating axes protruding from the servo motors 38 and extending through the mounting plates 35, so that servo motor 38 driving a particular pair of yarn feed rolls 36,37 would actually be on the opposite side of the mounting plate 35. The yarn feed rolls have outer teethed sections 40 to be engaged by drive sprockets 39 to advance the yarn feed rolls the desired increments for each stitch and the teethed sections 40 would also intermesh to synchronize opposed rotation of the two yarn feed rolls 36,37. The outside of the yarn feeding friction surfaces 41 is bounded by flange 42 to keep the plurality of yarns constrained on the yarn feeding surface. It can be seen that the total wrap of the yarns on the first yarn feed roll 37 is approximately 210° (or $7/6^{ths}$ $\pi$) and about the yarn feed surface of the second rear yarn feed roll 36 is approximately 180° ($\pi$), and the diameter of the yarn feeding surface 41 portion of these rolls 36, 37 was about three or four inches.

The use of yarn feed tubes introduces additional complexity and expense in the manufacture of the tufting machine, and a greater problem is posed by the differing distances that yarns must travel through yarn feed tubes to their associated needles. Yarns passing through relatively longer tubes to relatively more distant needles suffer increased drag resistance and are not as responsive to changes in the yarn feed rates as yarns passing through relatively shorter tubes. Accordingly, in manufacturing tube banks, compromises have to be made between minimizing overall yarn drag by using the shortest tubes possible, and minimizing yarn feed differentials by utilizing the longest tube required for any single yarn for every yarn.

As the use of servo motors to power yarn feed pattern devices evolved, it became more common to use many different stitch lengths in a single pattern. Prior to the use of servo motors, yarn feed pattern devices were powered by chains or other mechanical linkage with the main drive shaft and only two or three stitch heights, in predetermined ratios to the revolutions of the main drive shaft, could be utilized in an entire pattern. With the advent of servo motors, the drive shafts of yarn feed pattern devices could be driven at almost any selected speed for a particular stitch, providing different length increments of yarn as desired.

To avoid the necessity of tube banks, and with increasing computing power and servo controls available, single end servo scroll yarn feed attachments were developed. These single end attachments provide a separate servo driven yarn feed for each individual yarn and provide much greater control in the presentation of yarns to the backing fabric. However, due to the number of yarns on a broadloom tufting machine, which might number anywhere from several hundred to approximately two thousand strands of yarn, it became necessary for the yarn feeds to be quite compact. In addition, the yarn feeds were desired to be modular since across two thousand separate servo driven assemblies, the possibility of failure was such that modular replacement and repair was desirable. These compact assemblies are typified by the two assemblies shown in FIGS. 2A, 2B and FIGS. 3, 4. In these designs, the yarn feed rolls are of smaller diameter, often less than one inch, and certainly less than 5/4ths inches, reducing the mass of the rotational portion of the yarn feed.

It can be seen in FIGS. 2A, 2B that a servo motor 138 drives a sprocket 139 with teeth that intermesh in a teethed outer circumference 140 of first yarn feed roll 137 and the teethed outer surface 140 of that first yarn feed roll 137 is of sufficient width to also engage the teethed outer surface 140 of the second yarn feed roll 136 so that the two yarn feed rolls 137,136 rotate in synchronized and opposite fashion. Yarn feed rolls 137,136 are mounted to the mounting plate 135 with mounting bolts 145 allowing rotational movement and yarns 116 are threaded around the top of the yarn feeding surface 141 of the first yarn feed roll 137 and thence rearward and around the yarn feed surface 141 of the second yarn feed roll 136 and then forward towards the needles of the tufting machine. As such it can be seen that the wrap of the yarn 116 on yarn feed surface 141 of each yarn feed roll 136,137 is only approximately 180° (π), for a combined wrap of 360° (2π). In addition, to reduce the number of servo driven yarn feed rolls, in some instances, it would be preferred to thread two yarns 116 on each pair of yarn feed rolls 137,136 driven by a single motor and to accomplish a repeat of a pattern across the width of a tufting machine. This might be suitable for instance, to make two six foot wide rugs on a four meter wide tufting machine or to produce a pattern with a repeat or a pattern that is mirrored about a center line. Even four yarns could be placed on a pair of yarn feed rolls 136,137 and accomplish four repeats across the width on the tufting machine utilizing an appropriate tube bank to distribute the yarns 116. In this configuration of yarn feed rolls, the most readily available option to change the grip on the yarn being fed is by changing the yarn feeding surfaces 141 to have a different grit or frictional engagement with the yarn.

An alternative compact assembly such as depicted in U.S. Pat. No. 6,807,927 using relatively small yarn feed rolls and a pinch area 286 is shown in FIGS. 3 and 4. It can be seen that yarn 216 proceeds through the supply tube 213 and then between yarn feeding surfaces 283 of yarn feed rolls 282, 284. There is minimal, if any, wrap and the pinching of yarns leads to relatively rapid wear of surfaces 283 where the yarn 116 proceeds through the pinched area 286. In this construction the most readily available option for changing the grip on the yarn being fed is by changing the pressure between the feeding surfaces 283 of yarn feed rolls 282,284 and secondarily by changing the feeding surfaces 283 to have a different grit or frictional engagement with the yarn.

An additional effort at compact modular yarn feed design resulted in the use of three small yarn feed rolls as depicted in FIG. 5 (prior art from FIG. 4A of U.S. Publication 2018/0363186). In this case, the yarn 316 emerges from supply tube 313 and wraps over the yarn feed surface 305 of first yarn feed roll 384 and thence rearward and around yarn feed surface of the second yarn feed roll 382 and thence forward over a portion of the yarn feed surface 305 of third yarn feed roll 386 and downward. Meshing teethed portions at the base of the three yarn feed rolls insure that they turn in coopering directions and at uniform speed. It will be appreciated that the wrap around the yarn feed surface 305 of first yarn feed roll 382 is approximately 180° (π) and around second yarn feed roll 382 an additional 180° (π). The final partial wrap around the yarn feed surface 305 of third yarn feed roll 386 is only approximately 90° (½ π) so that the total wrap around all three yarn feed rolls comprises about 450° (5/2 π). This configuration does not provide threading alternatives around the three rolls, so once again, the most readily available option for changing the grip on the yarn being fed is altering the yarn feed surface 305 to have a different grit or frictional engagement with the yarn.

Even with these numerous advances in yarn feed configurations and optimized sizes for yarn feed rolls, there has been a continued need for improved yarn feed devices to accommodate the many varieties of yarn employed, the continually increasing speeds of operation of tufting apparatus, and the desire for even greater control over the provision of yarns to tufting machine needles. Accordingly, further improvements in yarn feed roller configurations and modular yarn feed assemblies are needed.

Smaller yarn feed rolls lack the amount of surface area to grip yarns that was present in initial larger diameter rolls as shown in FIGS. 1A and B, and it has been discovered even as much as frictional contact, the radians of wrap about the yarn feed rolls contributes greatly to the overall frictional or griping characteristics of the yarn feed roll surfaces upon the yarn or yarns that are being fed. As a result, it has been determined that increasing the degree of yarn wrap may provide better and more cost-effective compensation for the reduced yarn/friction surface interface than an aggressive gripping surface 41,141 or pinching action 286, in achieving precise yarn feed control. A four-roll servo driven yarn feed arrangement appears to provide optimal performance, flexibility, and cost characteristics.

BRIEF DESCRIPTION OF THE DRAWINGS

Particular features and advantages of the present invention will become apparent from the following description when considered in conjunction with the accompanying drawings in which.

DETAILED DESCRIPTION OF THE DRAWINGS

Figure 1A:
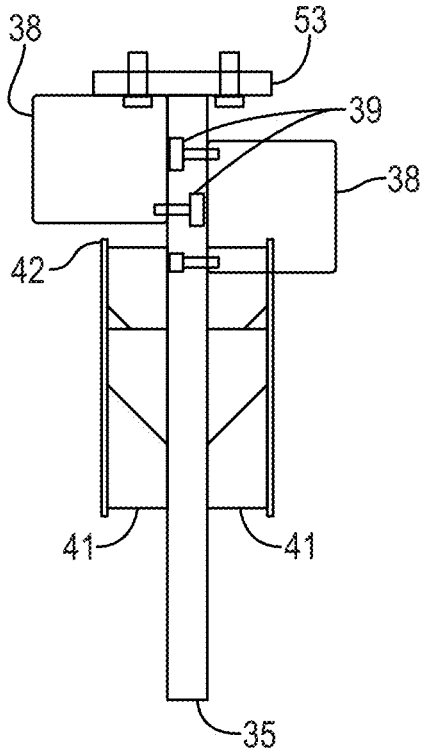
FIG. 1A (PRIOR ART)
FIG. 1A is a side plan view of a servo scroll yarn feed module as depicted in U.S. Pat. No. 7,089,874.
Figure 1B:
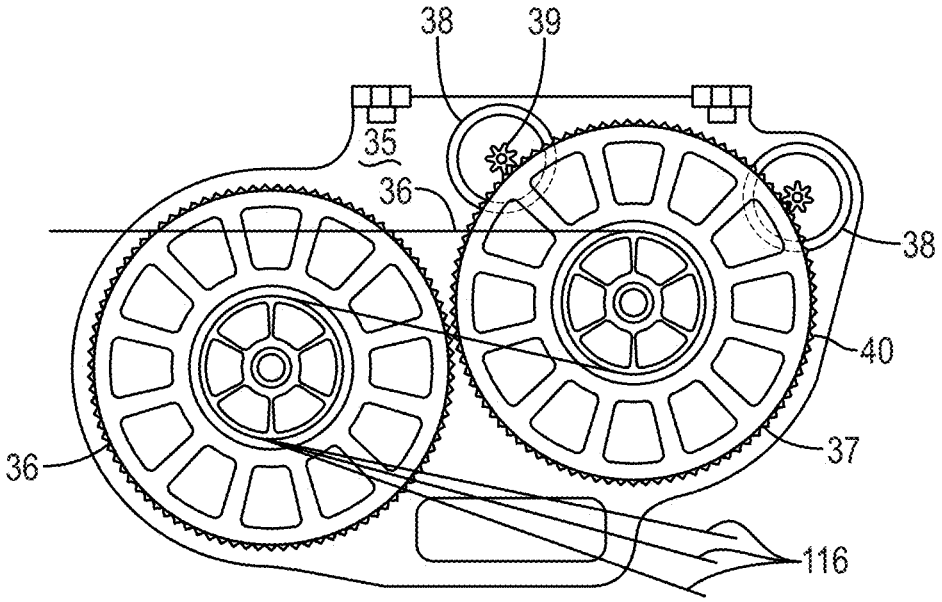
FIG. 1B (PRIOR ART)
FIG. 1B is an end plan view of the yarn feed module of FIG. 1.
Figure 2A:
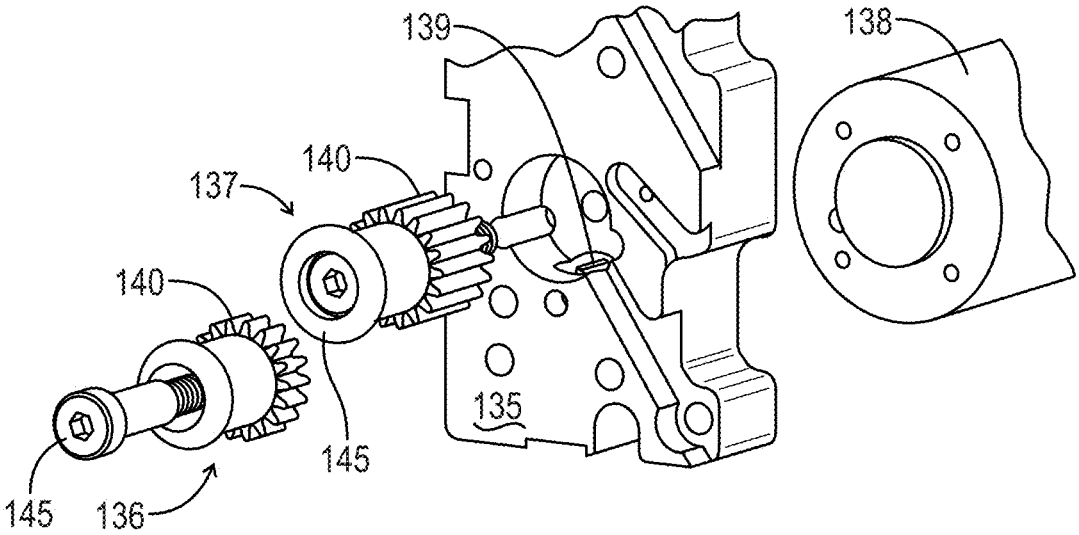
FIG. 2A (PRIOR ART)
FIG. 2A is an exploded view of a single end yarn feed module with two small diameter yarn feed rolls.
Figure 2B:
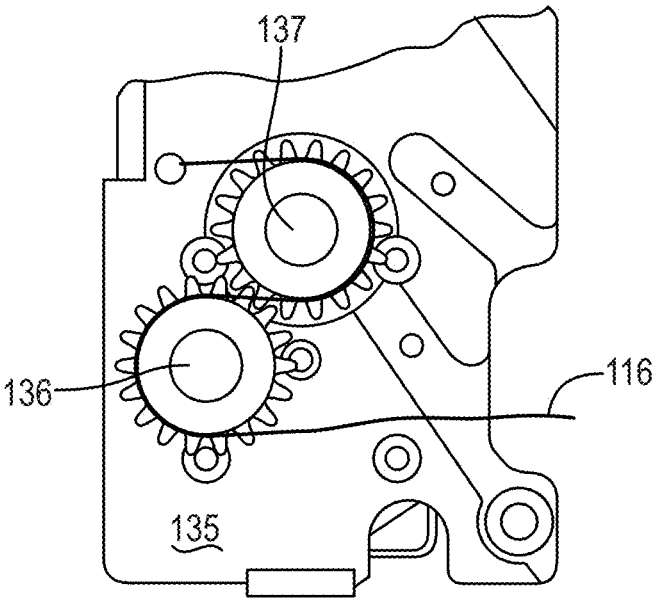
FIG. 2B (PRIOR ART)
FIG. 2B is a side plan view of the single end yarn feed module of FIG. 2A.
Figure 3:
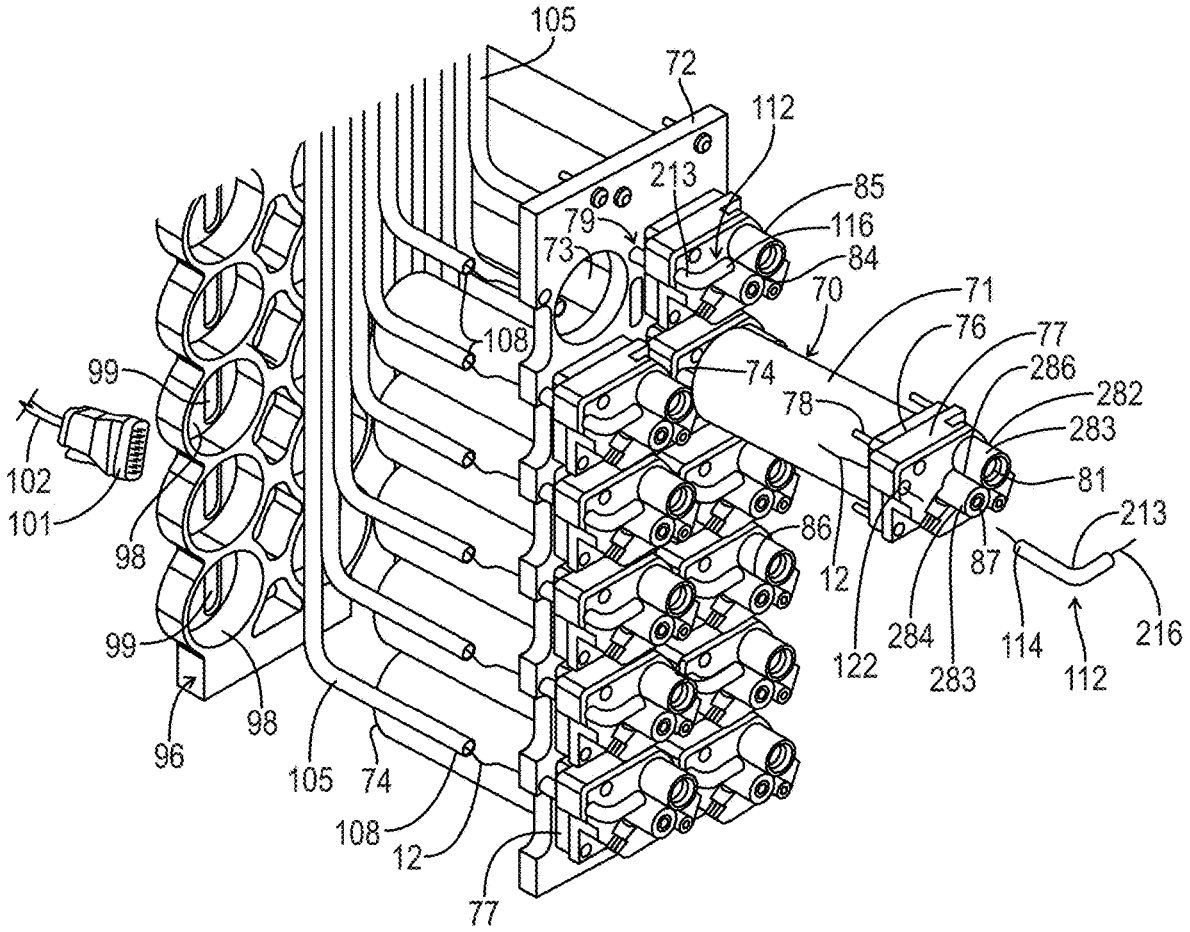
FIG. 3 (PRIOR ART)
FIG. 3 is a perspective view of a yarn feed system with a modular yarn feed motor and yarn feed pinch roller assembly as depicted in U.S. Pat. No. 6,807,927.
Figure 4:
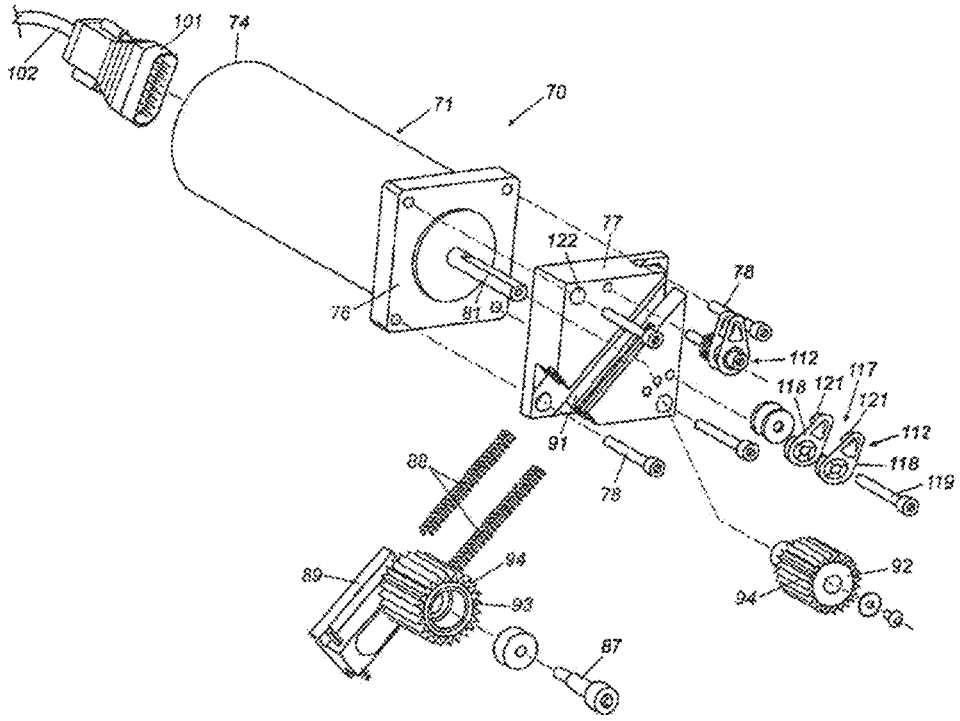
FIG 4 (PRIOR ART)
FIG. 4 is an exploded perspective view of the modular yarn feed motor and yarn feed pinch roller assembly of FIG. 3.
Figure 5:
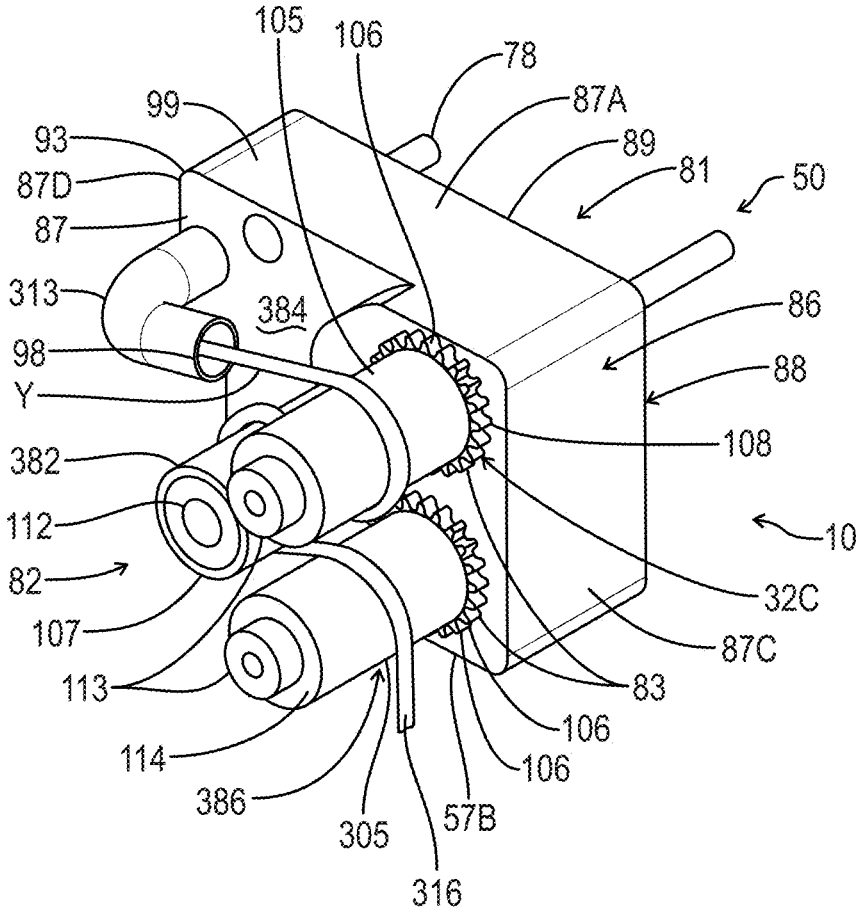
FIG. 5 (PRIOR ART)
FIG. 5 is a perspective view of a three roll yarn feed module as shown in U.S. Pub. 2018/0363186.
Figure 6A:
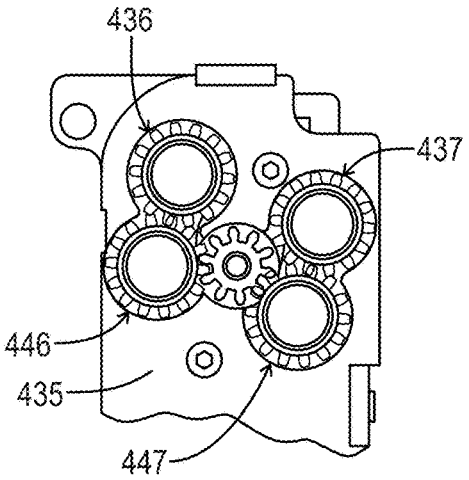
FIG. 6A is an exploded view of a four yarn feed roll yarn drive module.
Figure 6B:
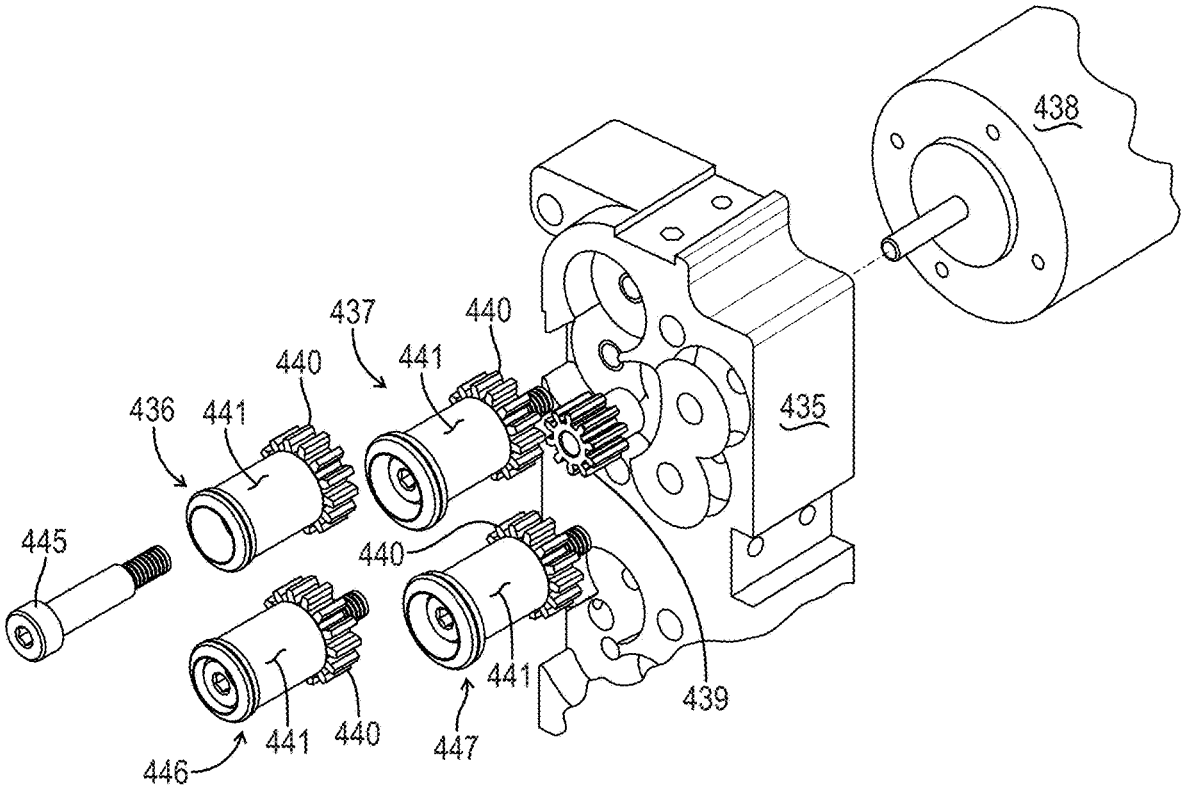
FIG. 6B is a side plan view of the four roll yarn feed module of FIG. 6A.

A presently preferred embodiment of a four-roll yarn feed module is shown in FIGS. 6-9, wherein in FIG. 6A a servo motor 438 is received on one side of a mounting plate 435 and on the opposite side a driven sprocket 439 interfaces with preferably two of the four yarn feed drive rolls 436, 437,446,447 on their teethed peripheries 440 that are preferably recessed into the surface of mounting plate 435. Yarn feed bolts 445 are utilized to rotatably secure yarn feed rolls 436,437,446,447 to the mounting plate 435 and serve as parallel axes of rotation for said rolls. Each of the yarn feed rolls 436,437,446,447 has a yarn feed surface 441 that may have differing gripping and durability characteristics as desired. The diameter of the yarn feed surface portions of the rolls is less than 1.5 inches and preferably closer to about one inch. This allows for compact construction and relatively low rotational mass to be controlled. If connected, the axes of rotation of the four yarn feed rolls generally correspond to vertices of a rectangle with roll 436 in the top left, roll 437 in the top right, roll 446 in the bottom left, and roll 447 in the bottom right. FIG. 6B provides a side plan view of an assembled yarn feed module from the side with protruding yarn feed rolls.

Figure 7:
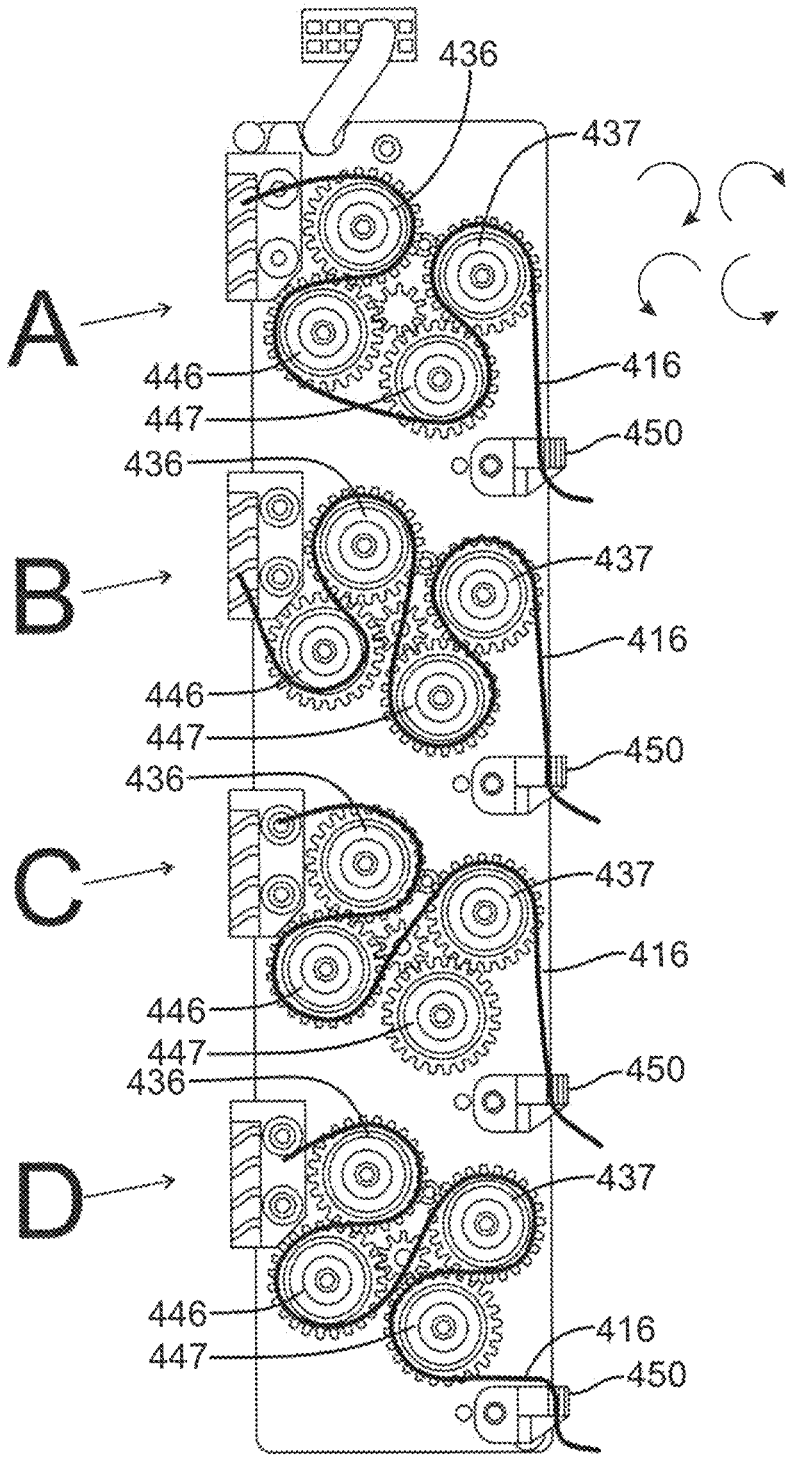
FIG. 7 is an exemplary illustration of four yarn feed roll modules with alternative yarn wrap or threading arrangements.

The yarns 416 may be threaded about yarn feed rolls 436,437,446,447 in a variety of ways as shown in FIG. 7. For instance, at the topmost yarn feed module designated A yarn proceeds around the top of yarn feed surface 441 of first yarn feed roll 436 and then rearward and around the bottom yarn feed surfaces 441 of lower yarn feed rolls 446,447 and thence upward and slightly rearward to go around and over the yarn feed surface 441 of yarn feed roll 437 and down to yarn guide 450 typically of ceramic construction. The amount of wrap on this yarn thread configuration is approximately 180° on roll 436, approximately 150° on roll 446, approximately 150° on roll 447 and approximately 270° on roll 437. This in aggregate compromises approximately 750° ($25/6^{ths}\ \pi$).

The second thread-up, designated B in FIG. 7, shows yarn proceeding beneath the bottom yarn feed surface 441 of lower left yarn feed roll 446 and upward and rearward to encircle much of the yarn feed surface 441 of upper left yarn feed roll 436 and downward and around yarn feed surface 441 beneath lower right yarn feed roll 447 and up and rearward and around yarn feed surface 441 of upper right yarn feed roll 437 so that aggregate wrap is approximately 180° on roll 446, approximately 270° on roll 436 and approximately 210° on roll 447 and approximately 270° on roll 437 to aggregate 930° of wrap ($31/6^{ths}\ \pi$).

The third alternative threading, designated C, around four yarn feed rolls has yarn 416 passing over the yarn feed surface of 441 of top left roll 436 and down and rearward around and beneath roll 446 and up and over roll 437, while entirely omitting the use of roll 447. In this fashion, the yarn is wrapped around slightly more than 180° of each of rolls 436,446,437 for an aggregate of over 540° (3 π).

The final illustrated threading, designated D, has yarn going over the yarn feed surface 441 of top left roll 436 and rearward around beneath lower left roll 446 and up over and around the yarn feed surface 441 of top right roll 437 and around and rearward beneath roll 447 so that wraps on each of rolls 436,446,447 are approximately 180° while the wrap on roll 437 is approximately in excess of 270° for a total wrap of 810° (9/2 π). The threadings of A-D are illustrative of different possibilities. It will be understood that generally all modules on a tufting machine will be threaded about the yarn feed rolls in the same fashion for a particular pattern and yarn selection.

Figure 8:
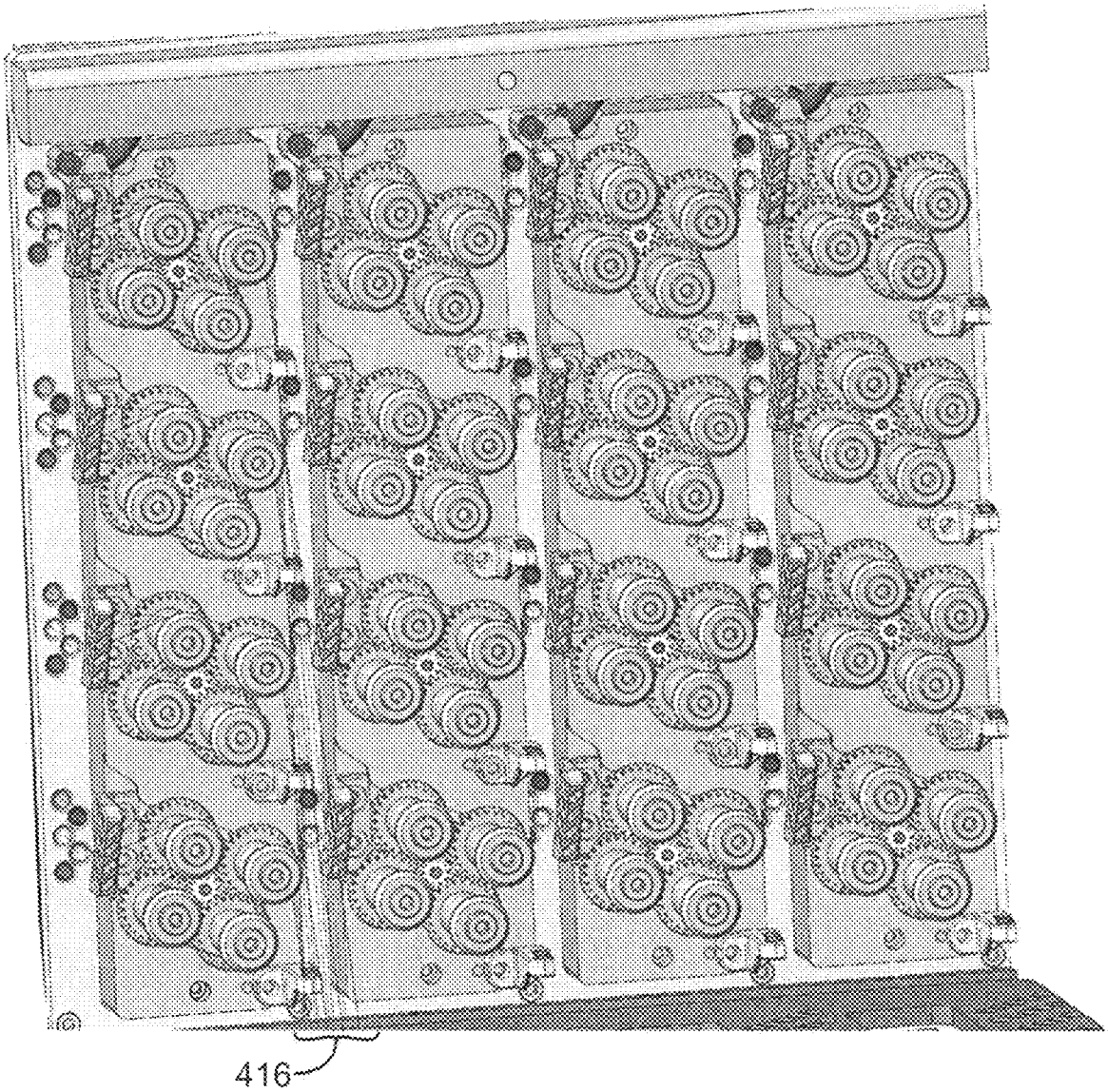
FIG. 8 is a perspective view of an array of four feed roll yarn feed modules.

FIG. 8 illustrates an array of four roll yarn feeds with yarn guides to allow for feeding four or even five yarns through each yarn feed module, such multi-yarn thread-ups generally being associated with the use of tube banks to distribute yarns from the yarn feed modules to desired needle locations.

Figure 9A:
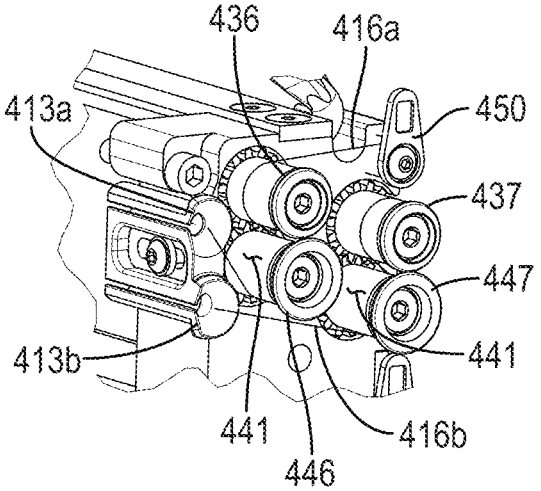
FIG. 9A though 9F depict arrangements of a four yarn feed roll module utilized to separately feed one or two yarns around yarn feed rolls.
Figure 9B:
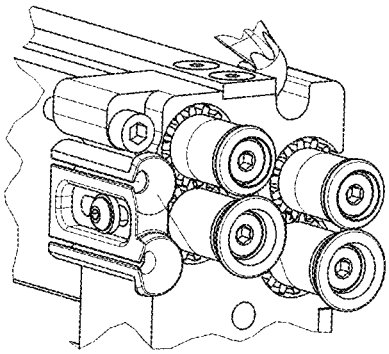
Figure 9C:
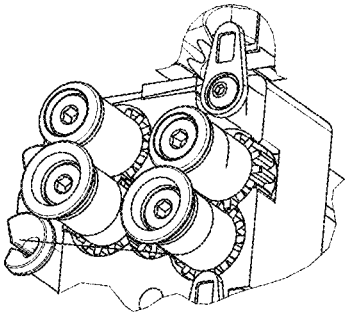
Figure 9D:
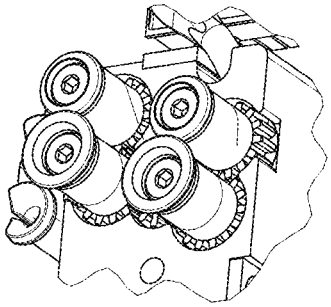
Figure 9E:
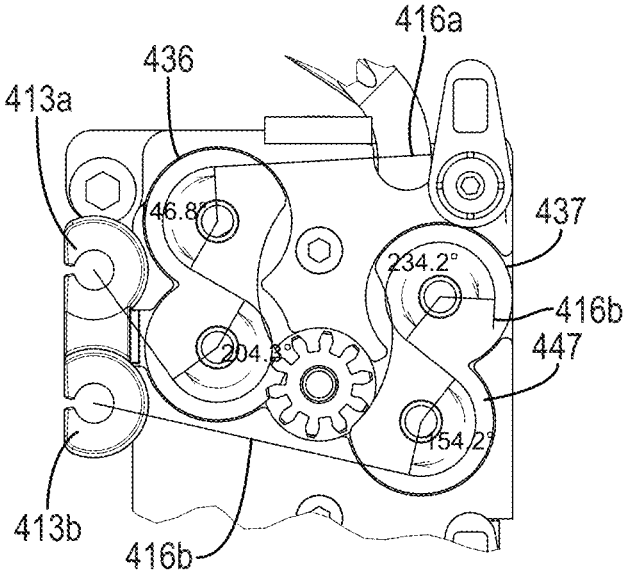

Turning then to FIGS. 9A-F, FIGS. 9B, 9C, 9D and 9F illustrate feeding of single yarns similar to those discussed in connection with FIG. 7. However, FIGS. 9A and 9E illustrate the feeding of two yarns, each being feed about the yarn feed surfaces 441 of two of the four yarn feed rolls. In FIG. 9A, first yarn 416*a* is fed from yarn guide 413*a* beneath the yarn feed surface 441 of yarn feed roll 446 then upward and rearward around yarn feed roll 436 and to yarn guide 450. A second yarn 416*b* emerges from yarn guide 413*b* and proceeds beneath yarn roll 447 and upward and rearward and over yarn feed roll 437 and thence to yarn guide. In this fashion, the yarn feed module receives two yarns that each are passed around two of the four yarn feed rolls and in that fashion the yarns do not bind with one another although each yarn will necessarily be fed in identical increments to the other on each stitch.

Figure 9F:
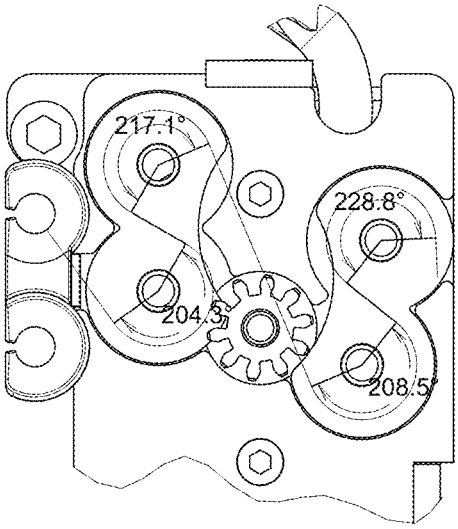

FIGS. 9E and 9F show detailed degree calculations for the amount of yarn wrap around the yarn feed rolls in their respective thread-ups.

It has generally been viewed as canon that three techniques could be utilized to minimize yarn slippage in pattern control yarn feed apparatus. One technique was to control the yarn by pinching between yarn feed rollers. Second technique was to use a gripping surface such as sandpaper to advance the yarns. A third technique was to apply the yarn along longer lengths of gripping surface material to increase frictional resistance, such as by using larger diameter yarn feed rolls. In practice, the application of pinching force for gripping created excessive wear on yarn feed roll components and the use of larger diameter yarn feed rolls introduced additional weight and momentum into the yarn feed system which not only created material expense but also the added momentum hindering precise high-speed changes in yarn feed speeds on a stitch-by-stitch basis. Coarse of sandpaper yarn feed surfaces provide increased yarn grip, however with some types of yarn these surfaces lead to snagging and wrapping yarns around the feed rolls instead of onward to the needles. Sandpaper or grit surfaces also wear and may require resurfacing to extend the lives of the yarn feed rolls.

The present invention is ideally implemented with an improved friction material which is a plasma coated/treated yarn feed roll plastic or polymer surface in lieu of sandpaper. This plasma treated surface provides some friction and enhanced durability while minimizing snagging and wrapping that may occur on sandpaper systems although without aggressively gripping yarns in the fashion of a coarse sandpaper yarn feed surface. The grip provided by the yarn feed rolls on the fed yarn may be adjusted by altering the amount of yarn wrap provided by the threading of the yarn modules. To provide secure yarn friction and grip, it has been determined that the increased yarn wrap provides not only frictional contact, but also the application of a variant of the capstan equation (or belt friction equation) providing that greater wrap around the yarn feed roll significantly increases the holding force of the rolls on the wrapped yarn. The capstan equation or Euler-Eytelwein formula provides:

$$T_{Load}=T_{Hold}^{e(\mu\theta)}.$$

$T_{Load}$, is the total load, $T_{Hold}$ is the total holding load, μ is the coefficient of static friction between the line or yarn and the roller and θ is the radians of wrap between the line (yarn) and capstan (yarn feed roll). Since a multi-roll yarn feed is not a single roll capstan, it is surprising to see that the general exponential relationship still seems to be applicable, even though not exactly as the capstan formula would predict.

The capstan equation provides that the relationship between load force and holding force varies exponentially with the frictional coefficient and the total amount of wrap between the feed roll and the yarn. The four-roll system and intelligent yarn threadup about the rolls greatly increases the radians of yarn wrap. Even though there is a slightly lowered friction coefficient from utilizing plasma treatment to enhance surface adhesion in lieu of a sandpaper of grit surface, the result is overall improvement in yarn control with a reduction in failures due to snagging, wrapping and bunching of yarns.

Even though the use of separate yarn feed rolls differs from multiple wrappings around a single capstan, experimentation showed a similar result in holding force on yarns. Experiments were conducted with a slick, low friction yarn, a relatively standard yarn, and a relatively hairy yarn with looser fibers more prone to snagging and wrapping. At one end of each test piece of yarn, the holding weight was attached and at the other end a force gauge sensor with a pull hook. Standard two roll and four roll faceplates were prepared so that the attached rolls were in proper arrangement but unable to spin freely, while providing an adjustable freely spinning roll to control yarn entry angle.

Each test was carried out by wrapping a length of yarn over the free-spinning entry roller and then through a running path of either the four roll or two roll configurations and force was slowly applied until the yarn slipped, and the peak force measured by the gauge was recorded and the test reset. Tests were conducted with the four-roll plasma configuration, a two-roll plasma configuration, and also a two-roll sandpaper configuration. The high friction, hairy yarn was readily grippable and also had a lower breaking force because of the looseness of its fibers so that it was consistently breaking before any slippage occurred. In the case of two-roll plasma configuration, additional weight on the holding side was required because the configuration had such a low coefficient friction there was not adequate gripping force with a light holding force. The greater weight or tension on the yarn increased the amount of friction applied by the two-roll system. Accordingly, the measurements obtained were useful in a relative sense but not completely comparable, and so the testing was only used to confirm the applicability of the capstan equation to multi-roll yarn feed, but did not provide a precise equation for determining grip so that some case-by-case experimentation is still deemed necessary depending upon the yarns and yarn feed requirement for a particular pattern.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed herein is:

1. A multiple needle tufting machine having a plurality of servo motor driven yarn feed modules for feeding yarns from a yarn supply to the needles wherein a servo motor drives a teethed sprocket that cooperates via teeth that intermesh with teethed sections of first and second yarn feed rolls mounted on parallel rotational axes for rotational movement, and the teethed section of the first yarn feed roll cooperates via teeth that intermesh to drive a teethed section of a third yarn feed roll, and the teethed section of the second yarn feed roll cooperates via teeth that intermesh to drive a teethed section of a fourth yarn feed roll.

2. The tufting machine of claim 1 wherein the first, second, third, and fourth yarn feed rolls each have a yarn feeding surface with a diameter of less than 1.5 inches.

3. The tufting machine of claim 1 wherein the first, second, third, and fourth yarn feed rolls each have a polymer yarn feeding surface that is plasma treated to enhance surface adhesion.

4. The tufting machine of claim 1 wherein a single yarn is fed through each of the yarn feed modules to a needle.

5. The tufting machine of claim 1 wherein at least two yarns are fed though each of the yarn feed modules and then through a tube bank and to selected needles.

6. The tufting machine of claim 4 wherein the first, second, third, and fourth yarn feed rolls each have a yarn feeding surface and the yarn is fed around portions of the yarn feeding surfaces of said first, second, third, and fourth yarn feed rolls so that the aggregate amount of wrap of the yarn on the yarn feeding surfaces is at least $3\pi$.

7. The tufting machine of claim 4 wherein the first, second, third, and fourth yarn feed rolls each have a yarn feeding surface and the yarn is fed around portions of the yarn feeding surfaces of at least three of said first, second, third, and fourth yarn feed rolls so that the aggregate amount of wrap of the yarn on the yarn feeding surfaces is at least $3\pi$.

8. A four roll yarn feed module for feeding yarns from a yarn supply to a needle on a multiple needle tufting machine comprising a servo motor mounted to rotationally drive a teethed sprocket, said teethed sprocket cooperating via teeth that intermesh with and drive teethed sections of first and second yarn feed rolls having yarn feeding surfaces mounted on parallel rotational axes for rotational movement, and the teethed section of the first yarn feed roll cooperating via teeth that intermesh to drive a teethed section of a third yarn feed roll having a yarn feeding surface, and the teethed section of the second yarn feed roll cooperating via teeth that intermesh to drive a teethed section of a fourth yarn feed roll having a yarn feeding surface.

9. The yarn feed module of claim 8 wherein the diameter of the yarn feeding surface portion of the first, second, third, and fourth yarn feed rolls is less than 1.5 inches.

10. The yarn feed module of claim 8 wherein the yarn feeding surfaces of the first, second, third, and fourth yarn feed rolls is a plasma treated polymer material.

11. The yarn feed module of claim 8 wherein a yarn is fed from the yarn supply around portions of the yarn feeding surfaces of said first, second, third, and fourth yarn feed rolls so that the aggregate amount of wrap of the yarn on the yarn feeding surfaces is at least $3\pi$.

12. The yarn feed module of claim 8 wherein a yarn is fed from the yarn supply around portions of the yarn feeding surfaces of at least three of said first, second, third, and fourth yarn feed rolls so that the aggregate amount of wrap of the yarn on the yarn feeding surfaces is at least $3\pi$.

13. The yarn feed module of claim 8 wherein at least two yarns are fed though the yarn feed module and then through a tube bank and to selected needles.

14. The yarn feed module of claim 13 wherein a first of the at least two yarns is fed from the yarn supply around portions of the yarn feeding surfaces of the first and third yarn feed rolls but not the yarn feeding surfaces of the second and fourth yarn feed rolls.

15. The yarn feed module of claim 14 wherein a second of the at least two yarns is fed from the yarn supply around portions of the yarn feeding surfaces of the second and fourth yarn feed rolls.

16. A method of threading a four roll yarn feed module for feeding yarns from a yarn supply to a needle on a multiple needle tufting machine that comprises a servo motor mounted to rotationally drive a first top left yarn feed roll, a second top right yarn feed roll, a third bottom left yarn feed roll, and a fourth bottom right yarn feed roll, with each of the first, second, third, and fourth yarn feed rolls having a yarn feeding surface, and being mounted on parallel rotational axes for rotational movement, comprising feeding yarn around portions of the yarn feeding surfaces of at least three of said first, second, third, and fourth yarn feed rolls so that the aggregate amount of wrap of the yarn on the yarn feeding surfaces is at least $3\pi$.

17. The method of claim 16 wherein the yarn is fed from left to right across the top of the yarn feeding surface of the first yarn feed roll and downward and to the left around the left side and bottom of the yarn feeding surface of the third yarn feed roll, and to the right across the bottom of the yarn feed surface of the fourth yarn feed roll and upward around the right of the yarn feed surface of the fourth yarn feed roll and upward and to the left around the left and top of the yarn feeding surface of the second yarn feed roll and toward a selected tufting needle.

18. The method of claim 16 wherein the yarn is fed from left to right across the bottom of the yarn feeding surface of the third yarn feed roll and upward and to the left around the left side and top of the yarn feeding surface of the first yarn feed roll, and downward to the right across the bottom of the yarn feed surface of the fourth yarn feed roll and upward around the right of the yarn feed surface of the fourth yarn feed roll and upward and to the left around the left and top of the yarn feeding surface of the second yarn feed roll and toward a selected tufting needle.

19. The method of claim 16 wherein the yarn is fed from left to right across the top of the yarn feeding surface of the first yarn feed roll and downward and to the left around the left side and bottom of the yarn feeding surface of the third yarn feed roll, and upward to the right around the left and top of the yarn feeding surface of the second yarn feed roll, and downward to the left across the top and left of the yarn feeding surface of the fourth yarn feed roll and toward a selected tufting needle.

20. The method of claim 16 wherein the yarn is fed from left to right across the top of the yarn feeding surface of the first yarn feed roll and downward and to the left around the left side and bottom of the yarn feeding surface of the third yarn feed roll, and upward around the left and top of the yarn feeding surface of the second yarn feed roll and toward a selected tufting needle.

* * * * *